US007872223B2

(12) United States Patent
Yamaguchi

(10) Patent No.: US 7,872,223 B2
(45) Date of Patent: Jan. 18, 2011

(54) MASS SPECTROMETER

(75) Inventor: Shinichi Yamaguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 282 days.

(21) Appl. No.: 12/296,360

(22) PCT Filed: Apr. 7, 2006

(86) PCT No.: PCT/JP2006/307469

§ 371 (c)(1),
(2), (4) Date: Oct. 7, 2008

(87) PCT Pub. No.: WO2007/116509

PCT Pub. Date: Oct. 18, 2007

(65) Prior Publication Data

US 2009/0159789 A1 Jun. 25, 2009

(51) Int. Cl.
*H01J 49/04* (2006.01)

(52) U.S. Cl. ..... 250/281; 250/288

(58) Field of Classification Search ..... 250/281, 250/282, 288

See application file for complete search history.

(56) References Cited

U.S. PATENT DOCUMENTS 6,956,208 B2 * 10/2005 Reilly et al. ..... 250/288
7,495,231 B2 * 2/2009 Truche et al. ..... 250/423 P

FOREIGN PATENT DOCUMENTS

JP 04-137442 A 5/1992
JP 2002-116184 A 4/2002

OTHER PUBLICATIONS

Shuichi Shimma, et al., "Applications of a Mass Microscope for Bionanotechnology", Journal of the Surface Science Society of Japan, Feb. 2006, pp. 79-85, vol. 27, No. 2.
Kiyoshi Ogawa, et al., "Research and Development of Mass Microscope", Shimazu Hyoron, Mar. 2006, pp. 125-135, vol. 62, No. 3.4.
Yasuhide Naito, "Mass Microprobe Aimed at Biological Samples", Journal of the Mass Spectrometry Society of Japan, Feb. 2005, pp. 125-132, vol. 53, No. 3.
Bernhard Spengler, et al., "Scanning Microprobe Matrix-Assisted Laser Desorption Ionization (SMALDI) Mass Spectrometry: Instrumentation for Sub-Micrometer Resolved LDI and MALDI Surface Analysis", Journal of the American Society for Mass Spectrometry, Feb. 2002, pp. 735-748, vol. 13, No. 6.

* cited by examiner

*Primary Examiner*—Kiet T Nguyen
(74) *Attorney, Agent, or Firm*—Sughrue Mion, PLLC

(57) ABSTRACT

A laser light is linearly delivered onto the sample 4. The ions generated from the irradiated area are collected, mass-separated in the mass separator 27, and detected by the detector 28. A mass analysis is repeated while moving the sample stage 3 by a predetermined step width in the x-axis direction so that the one-dimensional mass spectrum information of the sample 4 at a certain rotational position is obtained. Additionally, while the sample 4 is rotated by a predetermined angle, the same measurement is repeated for the entire perimeter, so that the one-dimensional mass spectrum information at each rotational position is obtained. Based on the data obtained in this manner, a reconstruction computational processing is performed by the CT method to reconstruct the two-dimensional distribution image for a substance having a certain mass for example and the image is displayed on the display 35.

9 Claims, 5 Drawing Sheets

MASS SPECTROMETER

TECHNICAL FIELD

The present invention relates to a mass spectrometer for mass-analyzing a one-dimensional area or a two-dimensional area on a sample in order to study the substance distribution or other data in the one-dimensional area or two-dimensional area.

BACKGROUND ART

Mass spectrometers are an apparatus for ionizing molecules and atoms of a sample component included in a gaseous, liquid or solid sample, and separating the ions in every mass-to-charge ratio to detect them in order to identify the sample component or determine the component amount. It is widely used today for a variety of purposes such as the determination of biological samples and analysis of protein or peptide.

In the fields of biochemistry and medicine, which treat living organisms, there is a great demand for obtaining the distribution information of protein included in a cell in vivo without destroying the cell. In order to meet such a demand, a mass microscope which has both the function of a microscope and that of a mass spectrometer has been developed in many places. With a mass microscope, it is possible to obtain information about a substance's distribution or other data in a two-dimensional area on a sample set on a preparation or the like.

FIG. 6 is a schematic configuration diagram of a conventional and general mass spectrometer of this kind. To the sample 4 placed on the sample stage 3 which is movable in biaxial directions of the x-axis and y-axis, a laser beam 2 with a narrow diameter for ionization is irradiated from the laser irradiator 1 for only a short period of time. In response to the laser irradiation, the sample components included in the sample 4 are ionized, and the ions generated are introduced to the mass separator 5 to be separated in every mass-to-charge ratio. Then, they are detected by the ion detector 6. In this figure, it is assumed that the mass separator 5 is a time-of-flight (TOF) mass separator which separates ions in every mass-to-charge ratio in accordance with the flight time difference; however, a mass separator of another configuration such as a quadrupole mass filter may be used.

In this configuration, the area on the sample 4 that can be mass-analyzed by one laser irradiation is very small. Hence, in order to perform a mass analysis for the entire sample 4 or across a rather wide area on the sample 4, a laser irradiation and a mass analysis corresponding thereto are repeated while the sample stage 3 is two-dimensionally moved by a stage drive unit which is not shown. With this operation, each piece of mass spectrum information which corresponds to a small region on the sample 4 is obtained, and based on this information, a two-dimensional image which illustrates a substance distribution or other information is created. Such a two-dimensional image will be hereinafter called "a two-dimensional substance distribution image."

With the aforementioned configuration, in the case where the two-dimensional area to be analyzed is large, the number of repeated analysis tasks will be enormous, and it takes a long time to obtain a two-dimensional substance distribution image. In addition, although the spatial resolution of a two-dimensional substance distribution image is determined by the laser irradiation area, the laser cannot be narrowed down to a diameter approximately a few dozen μm on the sample surface with current technology. Such a spatial resolution is not enough to observe a living cell or the like, and spatial resolution is required to be enhanced by one more orders of magnitude. However, it is difficult to achieve this only by modifying a lens optical system or other units for narrowing down the laser irradiation diameter. Even if the laser irradiation diameter can be narrowed down, another problem will arise: the amount of ion generation decreases since the area to be analyzed is small, which leads to the decrease of the analysis accuracy.

On the other hand, in terms of shortening the analysis time, a mass spectrometer having a configuration illustrated in FIG. 7 has also been proposed (see Non-Patent Document 1). That is, a large area on the sample 4 is irradiated with a planer laser light 12 by the laser irradiator 11 for a short period of time, and the sample components included in the sample 4 are ionized all together from the large area. Then, each ion is introduced to the time-of-flight mass separator 15 so that the ions retain the relative relationship of the ions' generation positions on the sample 4. After that, with the relative relationship being maintained, various kinds of ions generated from the same position are separated according to the mass-to-charge ratio and then detected by the two-dimensional detector 16. This configuration allows a mass analysis of the entire sample 4 or a relatively large area of the sample 4 with one laser irradiation.

However, with this configuration, the relative relationship of the ions' generation positions on the sample 4 is required to be maintained also on the detector plane of the two-dimensional detector 16. Although the scaling of the image can be performed according to necessity, in practice it is difficult to perform an ion transport which completely satisfies such a condition. In the case where the condition is not satisfied, the spatial resolution of a two-dimensional substance distribution image decreases, which makes the image blur. In the case where a sample including a sample component with a relatively large molecular weight is analyzed, there is a demand in some cases that the ions generated from the sample 4 are dissociated once or plural times to be fragmentized and then mass analyzed. For that purpose, an ion trap, a collision induced dissociation cell or other units are required to be placed along the ion pathway; however, this spoils the previously-described relative relationship of the ions' generation positions.

[Non-Patent Document 1] Yasuhide Naito, "Mass Microprobe Aimed at Biological Samples," *Journal of the Mass Spectrometry Society of Japan*, volume 53, no. 3, 2005.

DISCLOSURE OF THE INVENTION

Problems to be Solved by the Invention

The present invention is developed to solve the aforementioned problems and the first objective thereof is to provide a mass spectrometer capable of shortening as much as possible the amount of time required for obtaining a two-dimensional substance distribution image by a mass analysis of a two-dimensional area on a sample, at the same time, assuring a practically sufficient spatial resolution and accuracy, and furthermore, according to necessity, also analyzing the product ions generated by the dissociation of ions.

The second objective of the present invention is to provide a mass spectrometer capable of achieving a high spatial resolution even in the case where the convergence diameter of an energy ray such as a laser light to be delivered onto the sample for the ionization cannot be narrowed down.

Means for Solving the Problems

The first aspect of the present invention developed to solve the first objective provides a mass spectrometer for performing a mass analysis in a one-dimensional area or a two-dimensional area on a sample, including:

a) an irradiator for delivering an energy ray onto a one-dimensional area on a sample in order to ionize a sample component;

b) a mass analyzer for collecting ions generated from an area irradiated with the energy ray, and for separating and detecting the ions according to their mass-to-charge ratio;

c) a scanner for performing a linear scanning in which a relative position between the sample and the energy ray is linearly moved so that the area irradiated with the energy ray moves in a direction perpendicular to an extension direction of the irradiated area, and for performing a rotational scanning in which a relative position between the sample and the energy ray is rotationally moved so that the area irradiated with the energy ray rotates around an axis perpendicular to a surface of the sample;

d) an analysis performing controller for controlling the irradiator, the mass analyzer, and the scanner so that the scanner performs a movement operation in which the area irradiated with the energy ray is linearly moved on the sample by a predetermined step every time a relative position between the sample and the energy ray is rotationally moved by a predetermined angle, the mass analyzer performs a measurement after every movement operation, and the movement operation and the measurement are repeated at least for a semiperimeter around the axis; and e) an image reconstruction unit for performing, based on mass spectrum information obtained by combining the linear scanning and the rotational scanning by the mass analyzer, a two-dimensional image reconstruction process by a computer tomography (CT) method to obtain a two-dimensional distribution image for a substance having an intended mass-to-charge ratio.

The second aspect of the present invention developed to solve the second objective provides a mass spectrometer for performing a mass analysis in a one-dimensional area or a two-dimensional area on a sample, including:

a) an irradiator for delivering an energy ray onto a predetermined area on a sample in order to ionize a sample component;

b) a mass analyzer for collecting ions generated from an area irradiated with the energy ray, and for separating and detecting the ions according to their mass-to-charge ratio;

c) a scanner for moving a relative position between the sample and the energy ray so that the area irradiated with the energy ray moves on the sample;

d) an analysis performing controller for controlling the irradiator, the mass analyzer, and the scanner so that ions generated in correspondence to an irradiation with the energy ray in a first predetermined area on the sample are detected by the mass analyzer to obtain first mass spectrum information, and ions generated in correspondence to an irradiation with the energy ray in a second predetermined area including a part or entirety of the first predetermined area to obtain second mass spectrum information; and e) a processing unit for obtaining, based on a difference between the first mass spectrum information and the second mass spectrum information, mass spectrum information of a non-overlap region exclusive of an overlap region between the first predetermined area and the second predetermined area, and the mass spectrometer sequentially setting the non-overlap region in the one-dimensional area or two-dimensional area to be analyzed to obtain mass spectrum information for the area to be analyzed.

In the mass spectrometers according to the first and second aspects of the present invention, the energy ray for the ionization is typically a laser light. However, it may be another energy ray, such as an electron ray, neutron ray, fast atom beam or X ray, as long as it can be used for ionization. In the case where a laser light is used, the ionization can be performed using generally known surface assisted laser desorption/ionization (SALDI) methods, such as the matrix assisted laser desorption/ionization (MALDI) method or the desorption/ionization on (porous) silicon (DIOS) method, or any other heretofore known laser ionization methods.

In addition, in the mass spectrometers according to the first and second aspects of the present invention, the scanner is a means for moving one or both of the sample and the irradiator. It may be a means including a driving source such as a motor for moving a sample stage or sample holder for holding the sample in order to move the sample.

Effects of the Invention

In the mass spectrometer according to the first aspect of the present invention, the method of the CT is used in order to reconstruct the two-dimensional substance distribution image which illustrates the distribution of a substance (molecule) having a certain mass-to-charge ratio for example. In the well-known X-ray CT, an X-ray which passes through the target object to obtain a cross-sectional image is provided from one direction, and the passed X-ray is detected by a one-dimensional detector disposed opposite to the X-ray source across the target object to obtain the attenuation amount of the X-ray for each position. Then, the set of the X-ray source and the detector is rotated around the target object to measure, in every direction, the attenuation amount of the passed X-ray relative to the delivered X-ray. With the measurement result, a computational processing using a predetermined algorithm including a Fourier transformation and other algorithms is performed to reconstruct the two-dimensional tomographic image.

The first aspect of the present invention is analogous to the X-ray CT in many respects. For example, the present technique uses an energy ray for irradiating a one-dimensional area, and this energy ray corresponds to one X-ray flux which passes through a target object in the X-ray CT. The present technique obtains information by performing a measurement with the mass analyzer while linearly scanning the one-dimensional area, and this information is equivalent to that obtained by the X-ray irradiation from one certain direction and by the detection of the passed X-ray for the whole of the target object corresponding to the irradiation. The process of obtaining information is repeated while performing the rotational scanning, so that the information equivalent to the measurement for all the directions (at least for a semiperimeter) is obtained. The mass spectrum information obtained in this manner is equivalent to the measurement result for a two-dimensional cross section in the X-ray CT or similar methods. Therefore, it is possible for example, with the two-dimensional image reconstruction process by the CT method, to reproduce a two-dimensional image which illustrates the distribution of a specified mass-to-charge ratio.

The spatial resolution in this case depends on the width of the area irradiated with the energy ray, the step width of the linear scanning, the angle of the rotational scanning, and so on. However, it is possible to obtain a practically sufficient spatial resolution and accuracy with a relatively small number of repeated tasks of the mass analysis. In addition, although the ionization is concurrently performed not for a point-like small region but for a one-dimensionally covering area, the information indicating the ion's generation position in the area is not required. Hence, it is possible to collect all the ions generated from the one-dimensional area to make them simultaneously mass-analyzed. Accordingly, in one embodiment of the mass spectrometer according to the present invention, the mass analyzer may include: a first stage mass separator for selecting an ion having a specified mass-to-charge ratio as a precursor ion from among ions collected; a dissociation accelerator for dissociating the precursor ion into product ions; and a second stage mass separator for separating the product ions according to their mass-to-charge ratio. With this configuration, it is possible to examine the intensity distribution not only for the untouched ions generated from the sample but also for the product ions generated by dissociating the ions. This enhances the identification accuracy for each substance on the two-dimensional substance distribution image also for a biological sample for example.

In the mass spectrometer according to the second aspect of the present invention, a mass analysis is performed with the first and second predetermined areas respectively set so that the overlap region in which the regions to be analyzed overlap each other and the non-overlap region in which they do not overlap each other to obtain each of the first and second mass spectrum information. Since the mass spectrum information for the overlap region should be commonly included in the first and second mass spectrum information, calculating the difference between the first mass spectrum information and the second mass spectrum information provides mass spectrum information of the non-overlap region. Although the minimum value of the first and second predetermined areas' area depends on the irradiator's capability of narrowing down the energy ray, the minimum value of the non-overlap region's area basically depends on the scanner's minimum displacement step.

For example, in the case where the scanner is a movement mechanism including a motor for moving a sample stage for holding the sample, it is relatively easy to set the minimum displacement step to be on the order of 1 μm or below, which is dramatically small in comparison to the minimum aperture diameter of the laser light normally used as an energy ray for ionization. Hence, with the mass spectrometer according to the second aspect of the present invention, even in the case where the diameter of the energy ray such as a laser light cannot be narrowed down, the spatial resolution in creating a two-dimensional substance distribution image can be improved. Furthermore, in the mass spectrometer according to the second aspect of the present invention, the target area on the sample (i.e. the first and second predetermined areas) for which a mass analysis is practically performed to obtain the mass spectrum information is large. Hence, the amount of the generated ions is relatively large, and it is possible to improve the detection sensitivity for the sample components which are little contained and to create a two-dimensional substance distribution image with higher accuracy.

BEST MODES FOR CARRYING OUT THE INVENTION

First Embodiment

Figure 1:
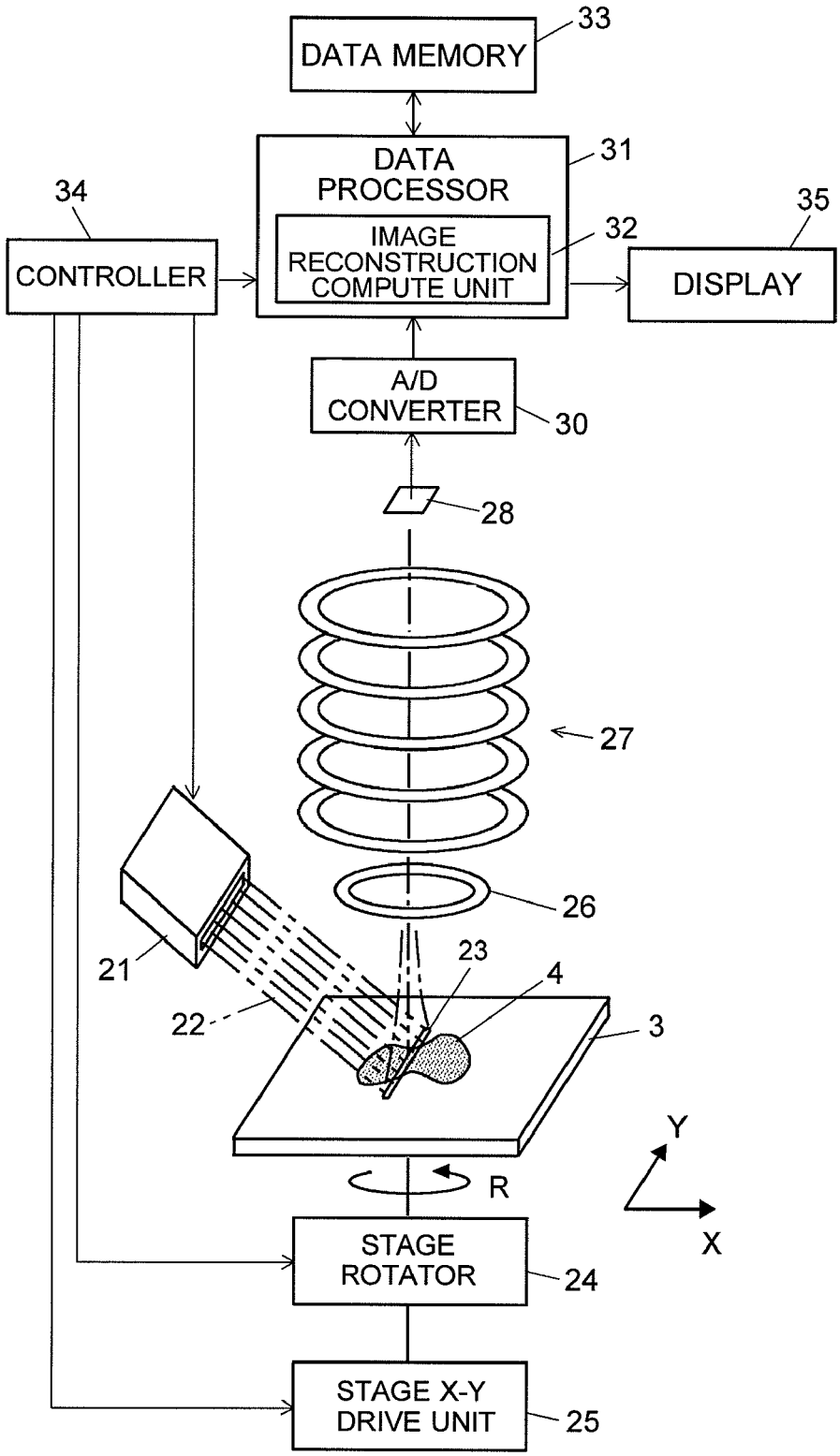
FIG. 1 is an overall configuration diagram of the mass spectrometer according to an embodiment of the first aspect of the present invention (first embodiment).
Figure 6:
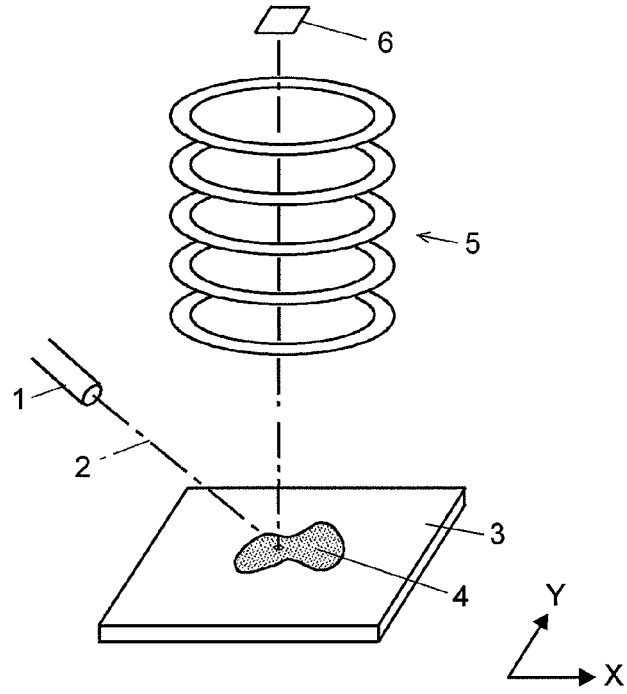
FIG. 6 is an overall configuration diagram illustrating an embodiment of a conventional mass spectrometer.
Figure 7:
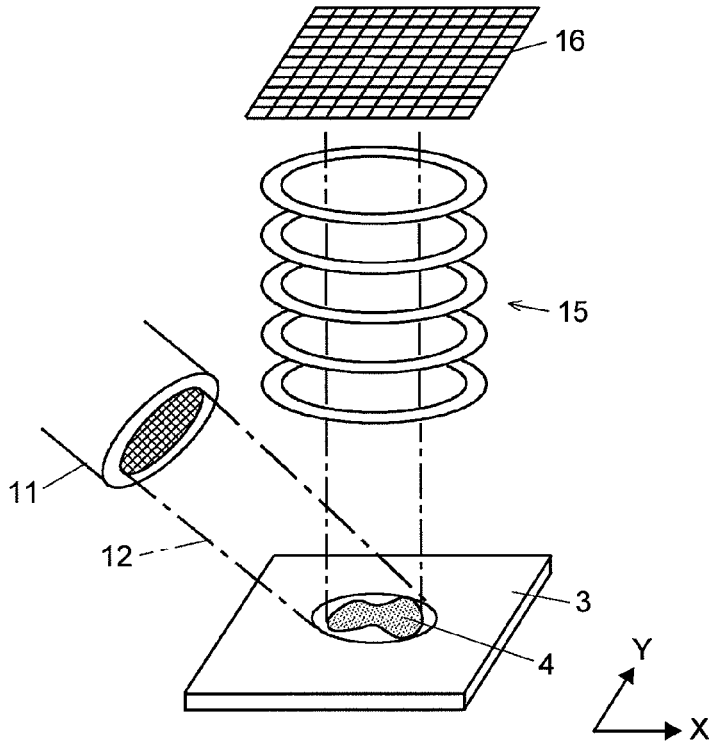
FIG. 7 is an overall configuration diagram illustrating an embodiment of a conventional mass spectrometer.

Regarding one embodiment of the mass spectrometer according to the first aspect of the present invention, its configuration and operation will be explained in detail. Hereinafter, this embodiment will be called the "first embodiment." FIG. 1 is an overall configuration diagram of the mass spectrometer of the first embodiment. In FIG. 1, the same components as in previously-described FIGS. 6 and 7 are indicated with the same numerals and the explanations are omitted.

In the mass spectrometer according to the present invention, the laser irradiator 21 delivers a laser light 22 onto a linear area having a predetermined length (i.e. one-dimensional area). The sample stage 3 can be rotated in the R-direction around the axis perpendicular to the stage surface by the stage rotator 24, and the sample stage 3 is also linearly movable, at each rotational position determined by the rotation as just described, in the x-axis and y-axis directions by the stage X-Y drive unit 25.

When the laser light 22 is delivered for a short period of time onto the sample 4 by the laser irradiator 21, the sample components included in the one-dimensional area 23 which is irradiated with the laser light 22 are ionized. The ions generated are collected by an ion collector 26 and introduced to the mass separator 27. In this embodiment, the mass separator 27 is a time-of-flight mass separator; however, it may be another unit such as a quadrupole mass filter. Hence, the ions generated from the one-dimensional area 23 are mixed independently of the positions in the one-dimensional area 23 and introduced to the mass separator 27. They are then separated according to the mass-to-charge ratio by the mass separator 27 and detected by the ion detector 28. The detection signal is converted into digital data by the analog/digital (A/D) converter 30 to be provided to the data processor 31. In the data processor 31, the data is stored in the data memory 33 as the mass spectrum data corresponding to the one-dimensional area 23.

In the mass spectrometer according to the present embodiment, under the control of the controller 34, while the sample stage 3 is moved in a rotational direction and linear direction by the stage rotator 24 and the stage X-Y drive unit 25 (i.e. while the rotational scanning and linear scanning are performed), a mass analysis for the one-dimensional area 23 on the sample 4 as previously described is performed. All the mass spectrum data ultimately obtained are computationally processed by the image reconstruction compute unit 32 to create the two-dimensional substance distribution image of a substance having a certain mass-to-charge ratio for example and display it on a window of the display 35.

Figure 2:
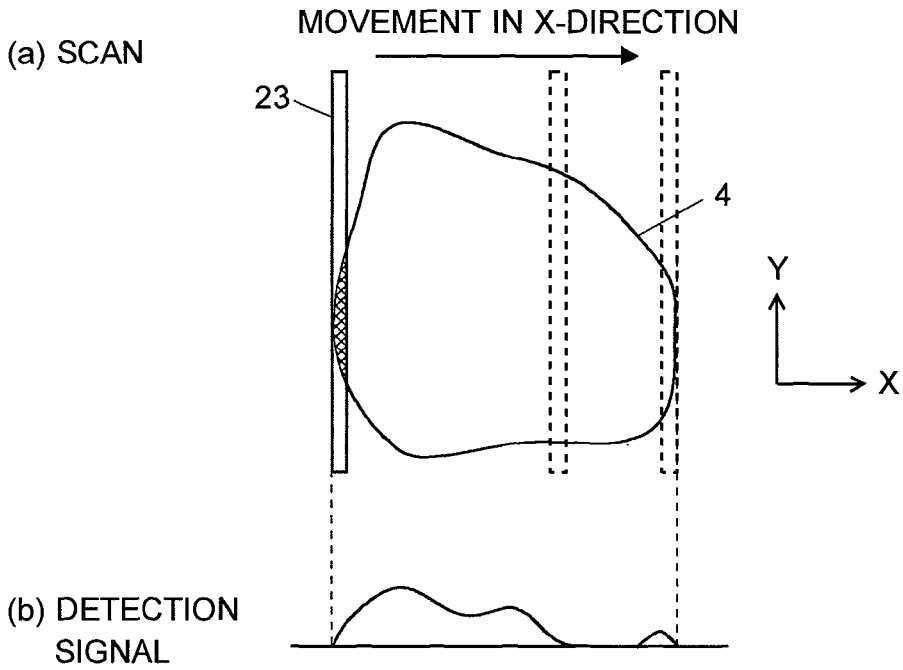
FIG. 2 is a pattern diagram for explaining the operation of the mass spectrometer according to the first embodiment.

Such a repeating operation of the movement of the sample stage 3 (i.e. scanning) and the mass analysis will be described with reference to FIGS. 2 and 3. As illustrated in FIG. 2, the sample 4 is placed on the sample stage 3. In this embodiment, it is presumed that the distribution of a substance having a predetermined mass-to-charge ratio M is to be examined across all of the two-dimensional areas on the sample 4.

In this case, as illustrated in FIG. 2(*a*), the sample stage 3 is moved by a predetermined step width in the x-axis direction by the stage X-Y drive unit 25 so that the one-dimensional area 23 onto which the laser light is delivered sequentially scans the sample 4 from one end (left end in this embodiment) to the other. Although the laser light 22 is also delivered on the sample stage 3 in this embodiment, the ions generated from the sample stage 3 itself are presumed to be negligible.

For every stepwise linear movement as previously described, the laser light 22 is delivered onto the one-dimensional area 23 for a short period of time, and the ions generated by this operation are mass analyzed. As the result of the mass analysis, the detection signal focusing on the predetermined mass-to-charge ratio M for example can be obtained as illustrated in FIG. 2(*b*). In addition, the detection signal focusing on other mass-to-charge ratios can be obtained in a similar manner. This is the mass analysis result for the sample 4 with the angular position of 0°.

Figure 3:
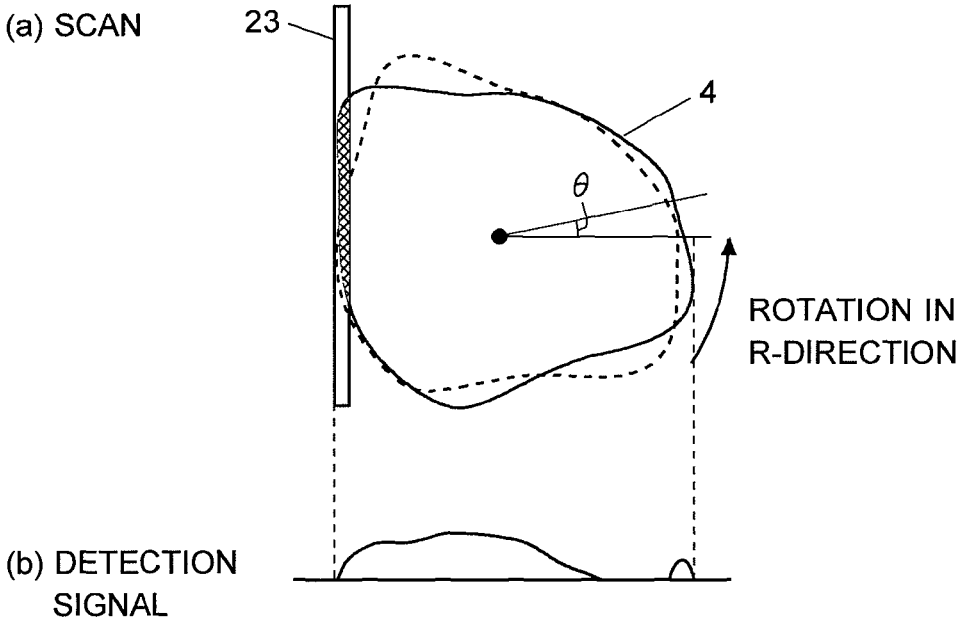
FIG. 3 is a pattern diagram for explaining the operation of the mass spectrometer according to the first embodiment.

Next, as illustrated in FIG. 3(*a*), the sample stage 3 is rotated by a predetermined angle θ (e.g. 1°) by the stage rotator 24 to turn the sample 4 in the R-direction. Since the extension direction of the one-dimensional area 23 onto which the laser light 22 is delivered does not change, the laser irradiation area for the sample 4 is inclined by the predetermined angle θ to the laser irradiation area with the angular position of 0°. From this state, the sample stage 3 is moved again in the x-axis direction by a predetermined step, and after every movement, the laser irradiation for a short period of time and the mass analysis of the ions generated from the irradiated area are performed. As the result of such a mass analysis, the detection signal focusing on the predetermined mass-to-charge ratio M can be obtained as illustrated in FIG. 3(*b*). This is the mass analysis result for the sample 4 with the angular position of θ.

As previously described, every time the sample stage 3 is rotated by a predetermined step angle θ, the linear scanning of the sample stage 3 for every predetermined step width in the x-axis direction is performed and the laser irradiation and the mass analysis are repeated to obtain the detection signal for the sample 4 at each angular position. Ultimately, the measurement as just described is repeated for the entire circumference (360°) in the R-direction to collect the detection signal. However, performing the measurement for a semiperimeter is sufficient because the information for the remaining semiperimeter is the same. Hence, the detection signal may be repeatedly collected for only half of the circumference. This is the data required to reconstruct the two-dimensional image.

The detection signals as illustrated in FIGS. 2(*b*) and 3(*b*) can be regarded as corresponding to the detection signal obtained in an X-ray CT for example by detecting an X-ray, which is delivered into a target object from an X-ray source and has passed through the target object, by a detector in which micro x-ray detection elements are linearly aligned. In an X-ray CT, since a parallel x-ray flux or a divergent x-ray flux is delivered into a target object, the detection signals can be obtained at a time by the detector. However, in the mass spectrometer according to the present embodiment, a linear scanning is required, which is the only difference. In the present embodiment, the sample 4 is rotated around the axis and the detection signal is obtained at each rotational position, which is the same with an X-ray CT. Hence, the data obtained in the manner as previously described is equivalent to that obtained by measuring a target object to observe a two-dimensional tomographic image in an X-ray CT. Therefore, if a two-dimensional image reconstruction computational process is performed on the aforementioned data by the CT method in the image reconstruction compute unit 32, it is possible to reconstruct a two-dimensional distribution image for a substance having a mass-to-charge ratio M for example. Since the image reconstruction computing by a CT method is well-known, a detailed explanation is omitted in this specification.

As previously described, in the mass spectrometer according to the present invention, a linear laser light is delivered onto the sample 4 to ionize the components included in the irradiated area, and the ions thereby produced are collected to be mass analyzed. The mass analysis is repeated while the sample 4 is linearly scanned and rotationally scanned to obtain the necessary data. Then, based on the data obtained, an image reconstruction computational process is performed by the CT method to construct a two-dimensional substance distribution image originating from the mass spectrum information.

As is clear from the previous explanation, in the mass spectrometer according to the present invention, the ions generated from the one-dimensional area 23 are simultaneously collected, i.e. regardless of the ions' generation positions, to be mass analyzed in the mass separator 27. Hence, an ion trap may be placed between the ion collector 26 and the mass separator 27 in order to temporarily store the ions so that those ions having a specified mass-to-charge ratio may be selected as precursor ions. After that, the precursor ions may be dissociated by the collision induced dissociation (CID) to produce various kinds of product ions, which are then launched from the ion trap and mass analyzed and detected in the mass separator 27. In such a configuration, a two-dimensional image illustrating the intensity distribution of a product ion having a certain mass-to-charge ratio for example can be obtained. Therefore, it is possible to obtain two-dimensional distributions for various kinds of substances included in a biological sample for example with higher accuracy.

Second Embodiment

Figure 4:
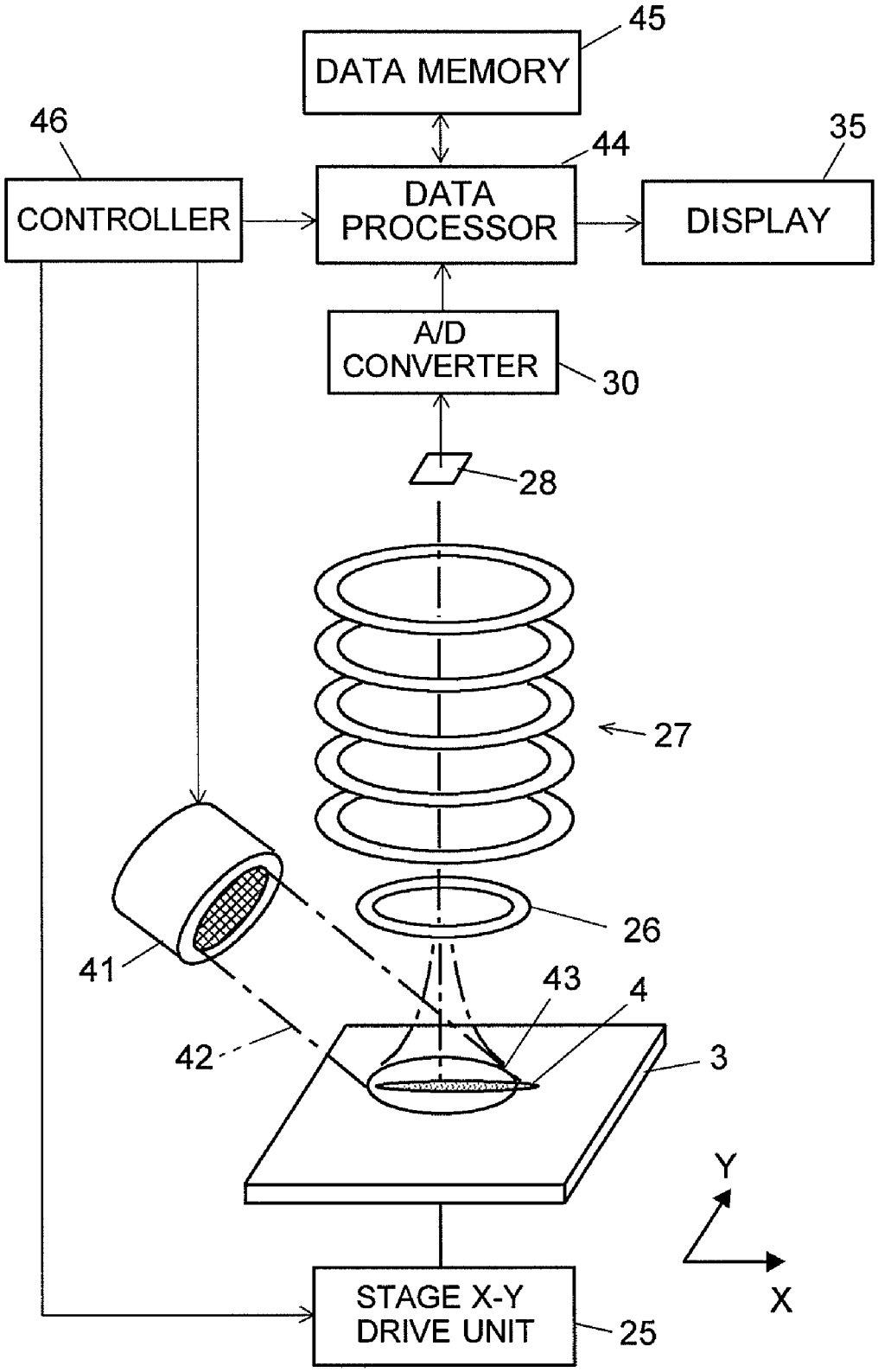
FIG. 4 is an overall configuration diagram of the mass spectrometer according to an embodiment of the second aspect of the present invention (second embodiment).

Regarding one embodiment of the mass spectrometer according to the second aspect of the present invention, its configuration and operation will be explained in detail. Hereinafter, this embodiment will be called the "second embodiment." FIG. 4 is an overall configuration diagram of the mass spectrometer of the second embodiment. In FIG. 4, the same components as in the previously described FIGS. 1, 6 and 7 are indicated with the same numerals and the explanations are omitted.

In the mass spectrometer according to the present embodiment, the laser light 42 diffusing to some extent is delivered onto the sample 4 from the laser irradiator 41. The ions generated from the irradiated area 43 on the sample 4 are collected by the ion collector 26 and introduced, in a mixed state, to the mass separator 27. In this mass spectrometer, the following two operations are completely different from those in the first embodiment: the scanning by the stage X-Y drive unit 25 for driving the sample stage 3 in order to set the irradiated area 43 on the sample 4, and the processing for the mass spectrum information, which is obtained in accordance with the scanning, by the data processor 44.

Figure 5:
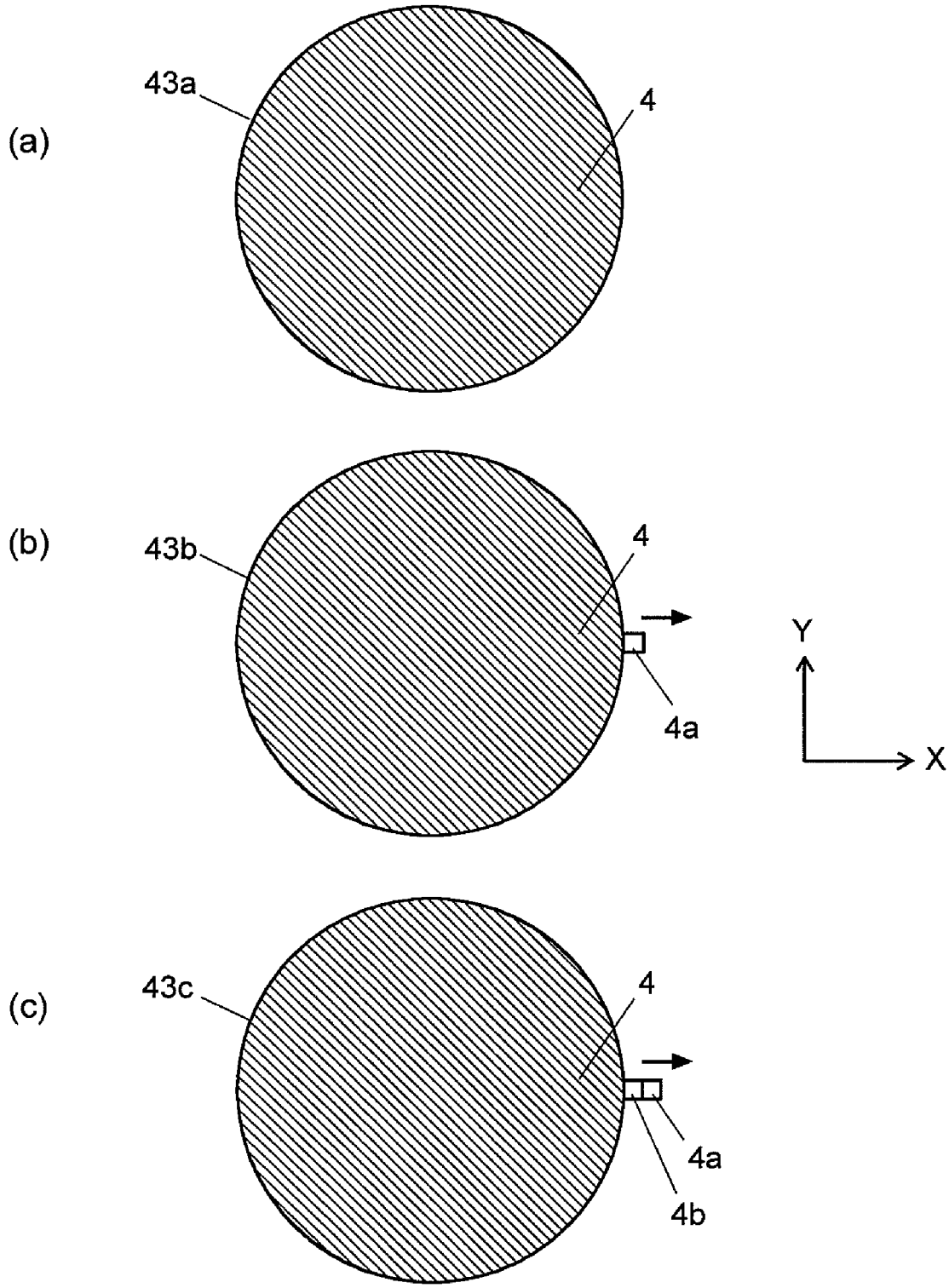
FIG. 5 is a pattern diagram for explaining the operation of the mass spectrometer according to the second embodiment.

In this respect, a simple example is explained with reference to FIG. 5. The sample 4 in this example is assumed to be linearly elongated in the x-axis direction. First, as illustrated in FIG. 5(*a*), the position of the sample stage 3 is set so that the entire sample 4 is within the laser irradiation area 43*a*. In this state, the laser light 42 is delivered for a short period of time, and the ions generated from the entire sample 4 are mass analyzed and detected to obtain the mass spectrum information D1. The ions generated from the sample stage 3 itself are presumed to be negligible also in this embodiment.

Next, the sample stage 3 is moved by a predetermined length in the x-axis direction from the position where the right end of the sample 4 coincides with the edge of the laser irradiation area 43*a* by the stage X-Y drive unit 25. As a result, as illustrated in FIG. 5(*b*), only a partial region 4*a* at the right end of the sample 4 is out of the laser irradiation area 43*b*. That is, the partial region 4*a* is the non-overlap region. In this state, the laser light 42 is delivered for a short period of time to perform a mass analysis as previously described. This time, the mass spectrum information D2 for the area in which only the partial region 4*a* is excluded from the whole sample 4 is obtained. Since the mass spectrum information D1 which was obtained earlier is for the entire sample 4, calculating the difference AD between the mass spectrum information D1 and the mass spectrum information D2 in the data processor 44 provides mass spectrum information for the partial region 4*a*. In this manner, it is possible to indirectly obtain the mass spectrum information corresponding to the small region 4*a* in the sample 4.

If the sample stage 3 is further moved by the predetermined length in the x-axis direction by the stage X-Y drive unit 25, as illustrated in FIG. 5(*c*), the partial regions 4*a* and 4*b* at the right end of the sample 4 move out of the laser irradiation area 43*b*. In this state, the laser light 42 is delivered for a short period of time to perform a mass analysis as previously described. This time, the mass spectrum information D3 for the area in which the partial regions 4*a* and 4*b* are excluded from the entire sample 4 is obtained. As in the previous case, calculating the difference ΔD between the mass spectrum information D2 and the mass spectrum information D3 in the data processor 44 provides mass spectrum information for the partial region 4*b*. In this manner, it is possible to indirectly obtain the mass spectrum information corresponding to the small region 4*b* in the sample 4. Since the mass spectrum information for all the small regions in the sample 4 can be obtained in this manner, it is possible to create the two-dimensional substance distribution image based on the information.

The spatial resolution in this case is determined by the step width of the sample stage 3, and generally the minimum step width can be set to be dramatically smaller than the laser Light's smallest light focus diameter. Hence, with the mass spectrometer according to the second embodiment, the spatial resolution can be a great deal higher compared to the case where the laser light is narrowed down to heighten the spatial resolution. Although the sample 4 has a linear shape in the previously described embodiment, it is possible to similarly obtain mass spectrum information even if the sample 4 has a two-dimensional area, by selecting a small region on the sample 4 as a non-overlap region and collecting mass spectrum information corresponding to each small region while sequentially shifting the non-overlap region.

In the mass spectrometers according to the first and second embodiments which were described earlier, a laser light is delivered onto a sample to ionize it. However, the ionization can be performed by delivering other energy rays such as an electron ray, fast atom beam, and a neutron ray. In addition, as previously described, the configuration of the mass separator is not limited to the previously described ones.

Also in other respects, it is evident that any modification, adjustment or addition properly made within the spirit of the preset invention is also covered within the scope of the present invention.

The invention claimed is:

1. A mass spectrometer for performing a mass analysis in a one-dimensional area or a two-dimensional area on a sample, comprising:

a) an irradiator for delivering an energy ray onto a one-dimensional area on a sample in order to ionize a sample component;

b) a mass analyzer for collecting ions generated from an area irradiated with the energy ray, and for separating and detecting the ions according to their mass-to-charge ratio;

c) a scanner for performing a linear scanning in which a relative position between the sample and the energy ray is linearly moved so that the area irradiated with the energy ray moves in a direction perpendicular to an extension direction of the irradiated area, and for performing a rotational scanning in which a relative position between the sample and the energy ray is rotationally moved so that the area irradiated with the energy ray rotates around an axis perpendicular to a surface of the sample;

d) an analysis performing controller for controlling the irradiator, the mass analyzer, and the scanner so that the scanner performs a movement operation in which the area irradiated with the energy ray is linearly moved on the sample by a predetermined step every time a relative position between the sample and the energy ray is rotationally moved by a predetermined angle, the mass analyzer performs a measurement operation after every movement operation, and the movement operation and the measurement operation are repeated at least for a semiperimeter around the axis; and e) an image reconstruction unit for performing, based on mass spectrum information obtained by combining the linear scanning and the rotational scanning by the mass analyzer, a two-dimensional image reconstruction process by a computer tomography (CT) method to obtain a two-dimensional distribution image for a substance having an intended mass-to-charge ratio.

2. The mass spectrometer according to claim 1, wherein the mass analyzer includes: a first stage mass separator for selecting an ion having a specified mass-to-charge ratio as a precursor ion from among ions collected; a dissociation accelerator for dissociating the precursor ion into product ions; and a second stage mass separator for separating the product ions according to their mass-to-charge ratio.

3. The mass spectrometer according to claim 2, wherein the energy ray is a laser light.

4. The mass spectrometer according to claim 2, wherein the scanner is a movement mechanism including a motor for moving a sample stage for holding the sample.

5. The mass spectrometer according to claim 1, wherein the energy ray is a laser light.

6. The mass spectrometer according to claim 1, wherein the scanner is a movement mechanism including a motor for moving a sample stage for holding the sample.

7. A mass spectrometer for performing a mass analysis in a one-dimensional area or a two-dimensional area on a sample, comprising:

a) an irradiator for delivering an energy ray onto a predetermined area on a sample in order to ionize a sample component;

b) a mass analyzer for collecting ions generated from an area irradiated with the energy ray, and for separating and detecting the ions according to their mass-to-charge ratio;

c) a scanner for moving a relative position between the sample and the energy ray so that the area irradiated with the energy ray moves on the sample;

d) an analysis performing controller for controlling the irradiator, the mass analyzer, and the scanner so that ions generated in correspondence to an irradiation with the energy ray in a first predetermined area on the sample are detected by the mass analyzer to obtain first mass spectrum information, and ions generated in correspondence to an irradiation with the energy ray in a second predetermined area including a part or entirety of the first predetermined area to obtain second mass spectrum information; and e) a processing unit for obtaining, based on a difference between the first mass spectrum information and the second mass spectrum information, mass spectrum information of a non-overlap region exclusive of an overlap region between the first predetermined area and the second predetermined area, and the mass spectrometer sequentially setting the non-overlap region in the one-dimensional area or two-dimensional area to be analyzed to obtain mass spectrum information for the area to be analyzed.

8. The mass spectrometer according to claim 7, wherein the energy ray is a laser light.

9. The mass spectrometer according to claim 7, wherein the scanner is a movement mechanism including a motor for moving a sample stage for holding the sample.

* * * * *